US005347791A

United States Patent [19]

Ginzl et al.

[11] Patent Number: 5,347,791

[45] Date of Patent: Sep. 20, 1994

[54] COMPUTER CONTROLLED HORIZONTAL WRAPPER

[75] Inventors: Jeffrey A. Ginzl; Gregory S. Duncan, both of Green Bay, Wis.

[73] Assignee: FMC Corporation, Chicago, Ill.

[21] Appl. No.: 78,796

[22] Filed: Jun. 16, 1993

Related U.S. Application Data

[63] Continuation of Ser. No. 971,887, Nov. 5, 1992, abandoned.

[51] Int. Cl.[5] ..... B65B 9/06; B65B 57/00

[52] U.S. Cl. ..... 53/450; 53/55; 53/75; 53/550

[58] Field of Search ..... 53/55, 51, 64, 75, 77, 53/450, 451, 550, 551, 552, 548; 364/469

[56] References Cited

U.S. PATENT DOCUMENTS

| | | | |
|---|---|---|---|
| 4,106,262 | 8/1978 | Aterianus | 53/450 |
| 4,506,488 | 3/1985 | Matt et al. | 53/55 |
| 4,525,977 | 7/1985 | Matt | 53/450 X |
| 4,549,386 | 10/1985 | Wilson | 53/51 |
| 4,712,357 | 12/1987 | Crawford et al. | 53/450 |
| 4,924,657 | 5/1990 | Berti et al. | 53/55 X |
| 5,079,902 | 1/1992 | Seko et al. | 53/450 |

FOREIGN PATENT DOCUMENTS

| | | |
|---|---|---|
| 0084299 | 7/1983 | European Pat. Off. . |
| 2176027 | 12/1986 | United Kingdom . |
| 2204296 | 11/1988 | United Kingdom . |

OTHER PUBLICATIONS

Search Report-FR 8612509, Feb. 4, 1987.

*Primary Examiner*—James F. Coan

*Attorney, Agent, or Firm*—Henry C. Query, Jr.; Richard B. Megley

[57] ABSTRACT

The horizontal wrapping machine of the type wherein a succession of articles are fed into a traveling tube of web material which is sealed longitudinally and severed and sealed between the articles to produce individual hermetically sealed packages. A variable speed motor drives a conveyor which may be provided with article feeding flights and a switch, actuated once each revolution of a timing shaft, provides a pulse corresponding to each flight on the article feeding conveyor. In addition an encoder driven by the variable speed drive motor shaft provides a digital velocity signal used as a reference signal for servo motors that may be coupled, in combination or individually, to drive web feed rolls, longitudinal sealing wheels and one or more sealing and severing heads. A delivery conveyor transporting individual packages may, through a suitable drive train, be driven by the variable speed drive motor. The velocity and position of the servo motors is established and controlled through an industrial computer, at a percentage of the velocity of the variable speed drive motor. Thus, the digital velocity and position signal input to the computer by the encoder driven by the variable speed drive motor establishes a reference velocity and positions the servo motors.

3 Claims, 8 Drawing Sheets

COMPUTER CONTROLLED HORIZONTAL WRAPPER

This application is a continuation of application Ser. No. 07/971,887, filed Nov. 5, 1992, and now abandoned.

This invention relates to a horizontal wrapping machine and more particularly to a wrapping machine provided with electronically controlled servo motors coupled to drive machine elements at a velocity and position dependent upon a reference velocity and position established by a master encoder coupled to a variable speed main drive motor.

Patented prior art relating to the subject matter of the present invention includes U.S. Pat. Nos. 4,525,977; 4,106,262 and 4,712,357. By reference to the above patents and references cited therein it is intended that they be incorporated herein.

The present invention incorporates a conventional variable speed main drive motor not only driving the wrapper receiving conveyor, but serving as a master drive in a computer controlled servo drive controlled scheme involving two or more slave drives joined to follow the movement of the main drive by control signals from a motion controlled computer. According to this arrangement, the servo driven horizontal wrapper is controlled digitally on a machine time rather than a real time basis.

Further, in accordance with the present invention, utilizing digital control techniques and providing proportional control of a horizontal wrappers' servo drive slave motors for rapid and accurate position error corrections makes possible quick size changeover with minimized production of scrap and enabling accurate cutoff and registration control during all wrapper operating phases. Moreover, providing a digital error proportional control scheme for web print registration compensates for gradual change of print repeat or feeding characteristics of the web driving elements.

Also, in accordance with the present invention, a computer controlled "high performance" drive arrangement enables the cutting head servo drive to run at relatively constant velocity since the variable cyclic velocity is achieved by a mechanical arrangement converting a constant input velocity to a variable cyclic velocity. Use of this mechanical arrangement lends itself to be adaptable for driving two or more cutting and sealing heads with one servo motor.

Further, according to the present invention, providing analog wrapping rate control of a digital computer controlled servo wrapper enables manual setting of wrapping rate with a potentiometer or automatic selection between multiple preset potentiometers or automatic response to an analog control signal from the process supplying the wrapper. This makes possible practical and conventional means for automatically controlling article backlog by cycling the wrapper responsive to the process control signal. Additionally, a computer controlled servo drive wrapping system employing a one to one switch for a pulse reference of an article rather than sensing articles or flights avoids or attentuates irregularities as the wrapper will ignore or not respond to minor irregularities of article position.

DETAILED DESCRIPTION OF PREFERRED EMBODIMENT

Figure 1:
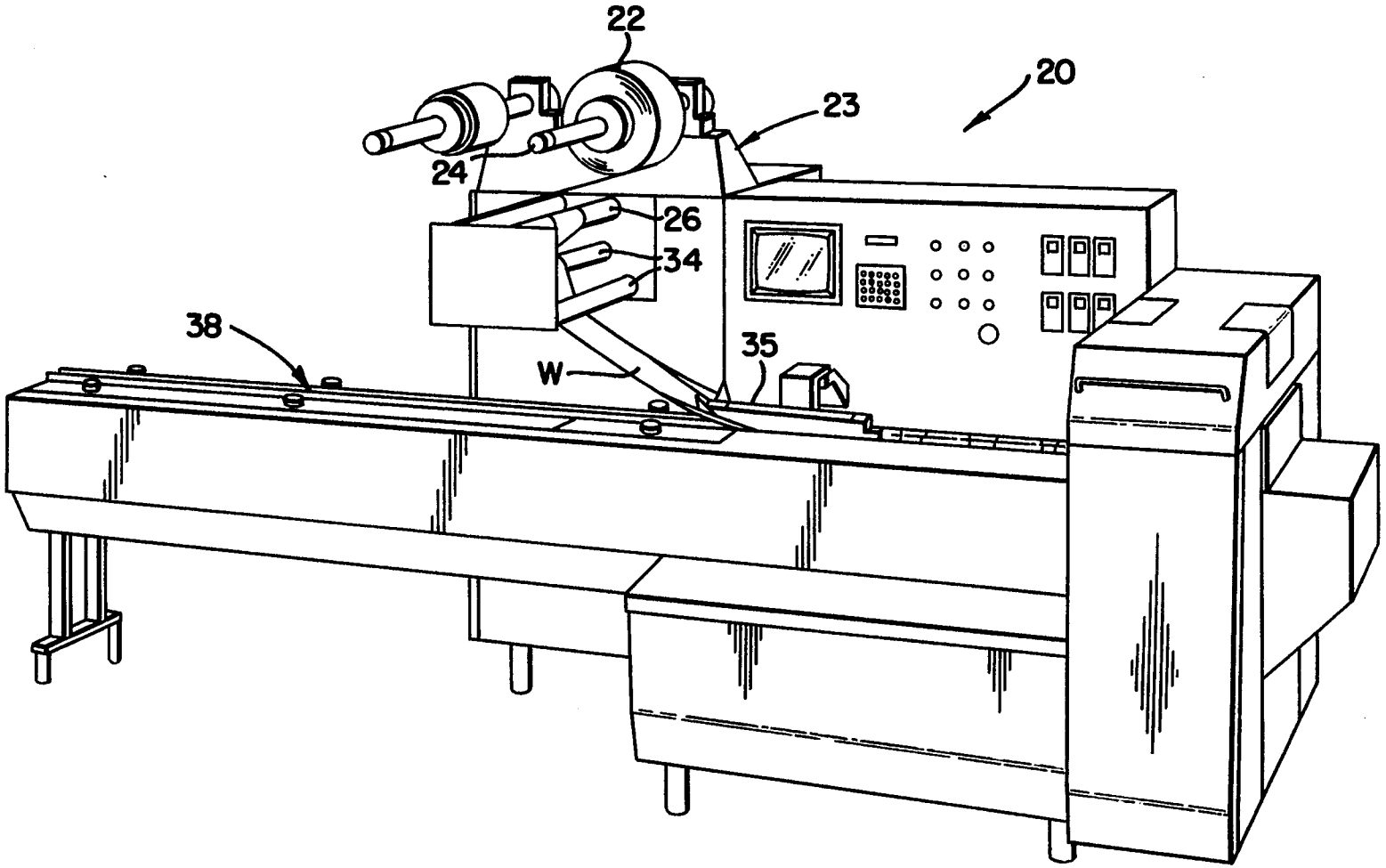
FIG. 1 is a perspective of a horizontal wrapping machine incorporating the novel subject matter of the present invention.
Figure 2:
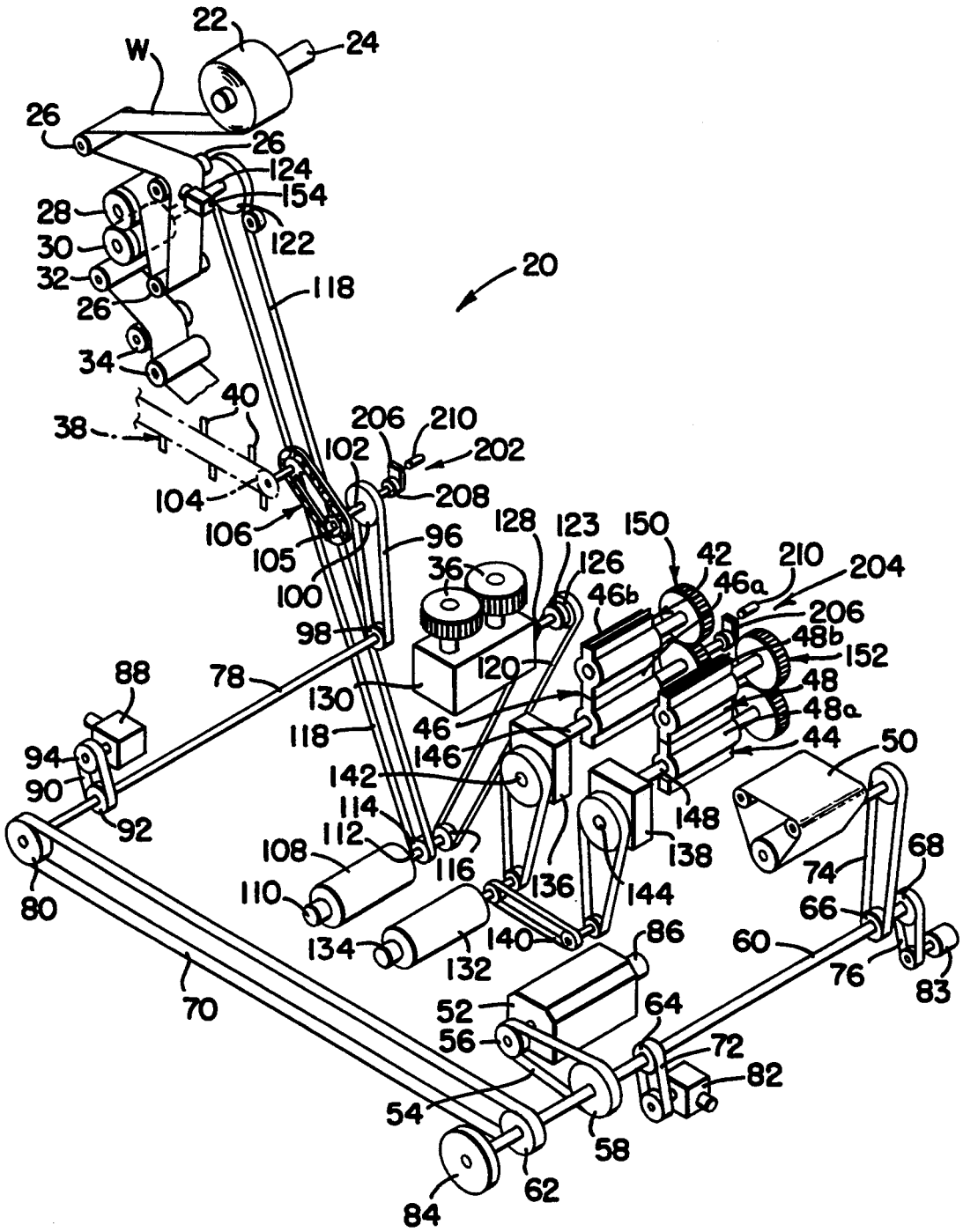
FIG. 2 is a perspective diagrammatic of a drive arrangement for a wrapping machine combining elements that achieve high performance capabilities and includes web drive rolls driven by a servo motor, FIG. 3, also a diagrammatic perspective, illustrates a wrapper configuration in which the web unwind from a roll of web material is achieved by servo driven tandem fin wheels.

A wrapping machine achieving high wrapping rates, which for purposes of this disclosure means 250 or more packages per minute, illustrated in FIGS. 1 and 2 is generally identified by the numeral 20. Web material supplied by a web roll 22 mounted on a suitable unwind stand 23 includes a support shaft 24. The web strip W is directed over idler rolls 26 and wrapped over and passed between nip rolls 28 and 30, one of which, preferably roll 28, is a rubber covered roll and the other roll 30 being a metal roll. The web strip passes over a roll 32 and over guide rolls 34 and thereafter is engaged by a forming device 35 of conventional construction functioning to form that flat web strip into a tube such that the opposed longitudinal edges form a longitudinal fin which is received between and sealed by heated fin wheels 36. An article supply conveyor 38, which may be provided with lugs or flights 40, feeds a supply of longitudinally spaced articles into the web tube produced by the former 35 which are then transported in spaced relationship by the web tube to one or more crimping devices operating to sever and seal the web tube along a transverse line in the region of the web tube unoccupied by articles. The wrapper configuration shown in FIG. 2 discloses tandem crimping and sealing heads 42 and 44 comprising crimping and sealing devices 46 and 48 that crimp, seal and sever the web tube during each 180 degrees of shaft revolution. Articles which have been sealed within a portion of the web tube are discharged to a delivery conveyor 50 from which the completed packages are either manually or automatically cartoned for shipment According to the present invention a conventional variable speed motor 52, preferably a DC motor, is connected to drive the infeed conveyor 38, the delivery conveyor 50 and, through suitable power takeoffs, upstream and downstream accessories that may be incorporated in the wrapping system. The conventional motor 52, sometimes hereinafter referred to as the master or main drive motor, is coupled to a master encoder 83 which provides a machine time signal to a computer which controls slave servo drives with encoders to follow the movement of the master encoder 83. The computer controlled high performance drive arrangement as shown in FIG. 2 provides a drive arrangement whereby a servo motor slaved to the main drive runs at relatively constant velocity while the crimping heads 42 and 44 driven thereby operate at variable cyclic velocity through a mechanical arrangement converting the constant velocity input from the servo motor to cyclic variable velocity.

With reference to FIG. 2 it will be seen that the main or master motor 52 drives, by a belt 54 connecting the pulley 56 mounted on its output shaft and a pulley 58, an elongate transverse shaft 60 having fixed along its length pulleys 62, 64, 66 and 68 driving, by means of timing belts 70, 72, 74 and 76, an upstream elongate transverse shaft 78 mounting a pulley 80 driven by the belt 70, a power take off unit 82, the delivery conveyor 50 and an encoder 83, respectively. At its outboard end the shaft 60 has keyed thereon and a hand wheel 84. The main motor 52 may also be provided with a tachometer 86 serving to improve or maintain constant closed loop velocity control.

The elongate transfer shaft 78 driven by the main motor 52 through the belt 70 drives a PTO 88 through a belt 90 interconnecting pulley 92 and pulley 94 fixed to the input shaft of the PTO 88. PTOs 82 and 88 may be used to drive a plurality of accessories such as automatic feeders, carad sheeters, code daters, printers, imprinters, punching stations, collators, cartoners, and a variety of other accessories that are necessary to fulfill particular wrapping requirements. By means of a belt 96 and associated pulleys 98 and 100 fixed to, respectively, shaft 78 and a shaft 102 the article supply conveyor 38 is driven to supply a succession of articles carried thereby into the web tube. A drive pulley or sprocket 104 of the conveyor 38 is connected to the shaft 102 by a sprocket-chain drive 106. Changes in speed in the article supply conveyor 38 due to product length determining the distance between flights or lugs 40 and are preferably achieved by changing sprocket 105 of the drive 106 to thereby produce a drive ratio proportional to the wrapper speed. The disclosed arrangement of changing the feed conveyor speed is relatively simple and inexpensive and it is satisfactory for a majority of wrapper applications.

The web drive nip rolls 28 and 30 and the fin wheels 36 are driven by a servo motor 108 provided with a suitable shaft encoder 110 supplying velocity signals to an industrial motion computer which will hereinafter be identified. On the output shaft 112 of servo 108, mounting pulleys 114 and 116 drive, by means of belts 118 and 120, respectively, the nip roll 30 through a pulley 122 mounted on a shaft 124 and the fin wheels 36 by a pulley 126 secured to an adjustable torque device 123 mounted on a shaft 128 extending from a gear box 130 operating to concurrently rotate the fin wheels 36.

Another servo motor 132, having coupled thereto an encoder 134, drives crimping and sealing heads of 42 and 44. Variable cyclic velocity to the crimping heads is provided by mechanical slot drive units 136 and 138 which are of conventional construction. The servo motor 132, through a belt and pulley transmission generally identified as 140, drive units 136 and 138. Power input shafts 142 and 144 associated, respectively, with the slot drive units 136 and 138, drive output shafts 146 and 148 at a cyclic variable velocity such that when the crimping and sealing faces of the crimping devices 46 and 48 come in contact with the web tube the velocity matches that of the web tube. The lower crimpers **46*a* and 48*a* are fixed, respectively, to output shafts 146 and 148 and by means of gear sets 150 and 152 the upper crimping heads 46*b* and 48*b* are concurrently driven in time relation with crimpers 46*a* and 48*a***.

In the event film with a printed registration mark is used, a film registration mark detector 154 generates a signal which is input to the motion control computer being programmed to control servo motor 108 to maintain a preset phase relationship between the printed web register marks and the flights 40 of the article supply conveyor 38. Such a relationship achieves very accurate control of the web cutoff and print registration by controlling the drive to the web feed rolls 28 and 30.

Figure 3:
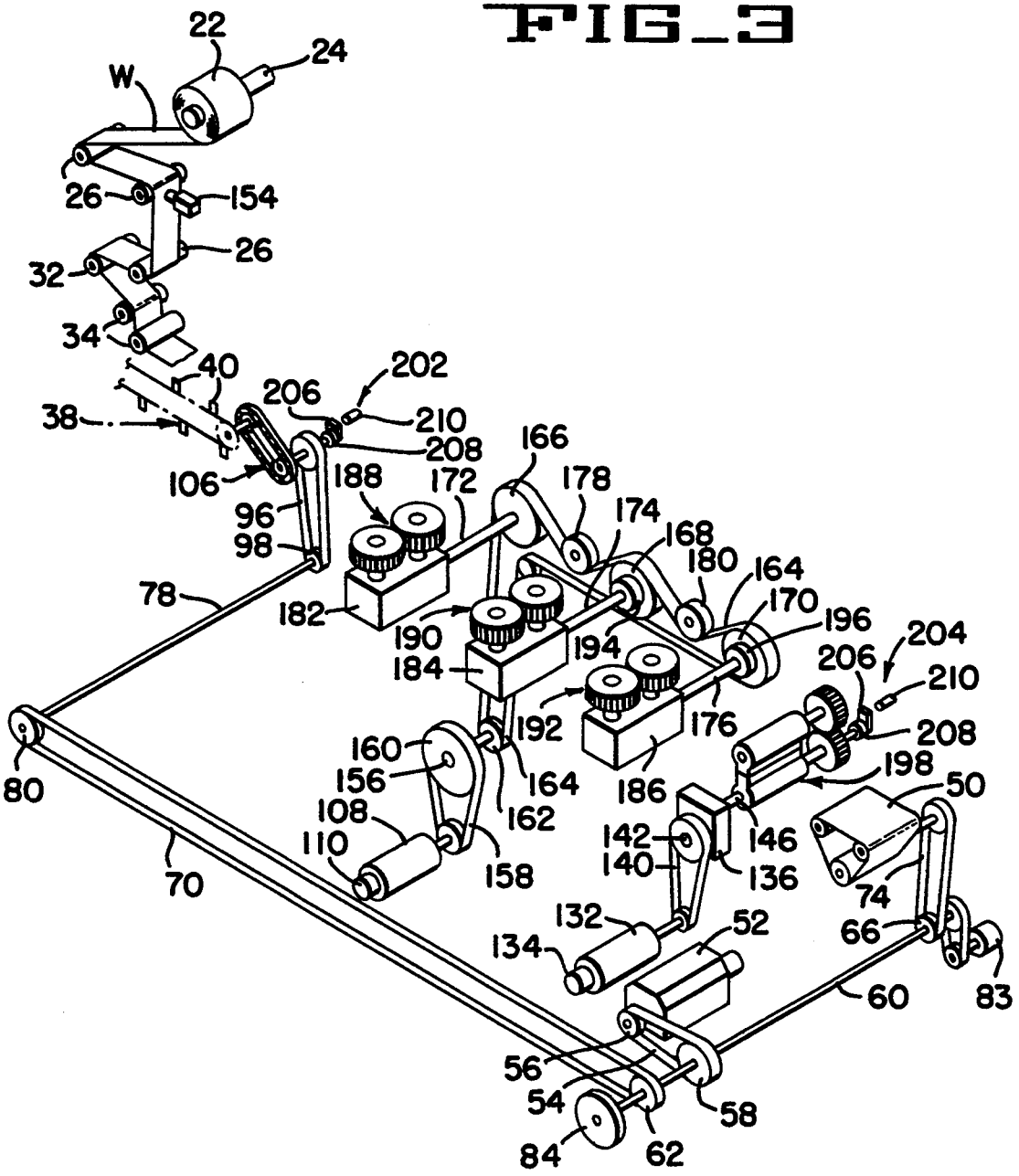

The drive arrangement of the wrapper shown in FIG. 3 is in major respects similar to the above described arrangement and the same numerals will be used to identify the same or similar elements. The principle modifications involve the absence of web drive rolls 28 and 30, one of the crimping heads and the provision of three sets of fin wheels driven by servo motor 108. As shown in FIG. 3 the servo motor 108 drives a shaft 156 by belt 158 engaging a pulley 160 keyed to shaft 156. Shaft 156 also mounts a pulley 162 driving a belt 164 passing over drive pulleys 166, 168 and 170 keyed, respectively, to shafts 172, 174 and 176. Idler pulleys 178 and 180 serve to increase the arc of contact between the belt 164 and the drive pulleys 166, 168 and 170. Gear boxes 182, 184 and 186 drive opposed pairs of fin wheel 188, 190 and 192 with the driving power therefore being supplied by the shafts 172, 174 and 176, respectively.

According to the construction of FIG. 3 the rate at which web is unwound from the supply roll is directly related to the velocity of servo motor 108 and accordingly the surface velocity of the fin wheels directly corresponds to a desired film velocity. To establish a predetermined web tension between the fin wheel 188 and the web as it is unwound from the supply roll 22 a conventional drag brake may be utilized. Fin wheels 190 and 192 serve to provide a predetermined tension to the web by incorporating adjustable torque devices 194 and 196 on shafts 174 and 176. Commercially available adjustable torque devices provide a percentage of overspeed when unloaded (herein meaning when running without web) and when loaded slip at a preset torque level to produce a desired degree of web tension to the web portion between the fin wheels.

FIG. 3 illustrates a crimping head 198 driven at cyclic variable velocity by the servo drive unit 132, but it should be noted that the crimping head engages, crimps and severs the web once during each revolution of the shaft 146. In the art this is referred to as a "1-up head" while the crimping heads 42 and 44 shown in FIG. 2 are usually referred to as "2-up heads" since during each 360 degree revolution two crimps and seals are made.

Figure 4:
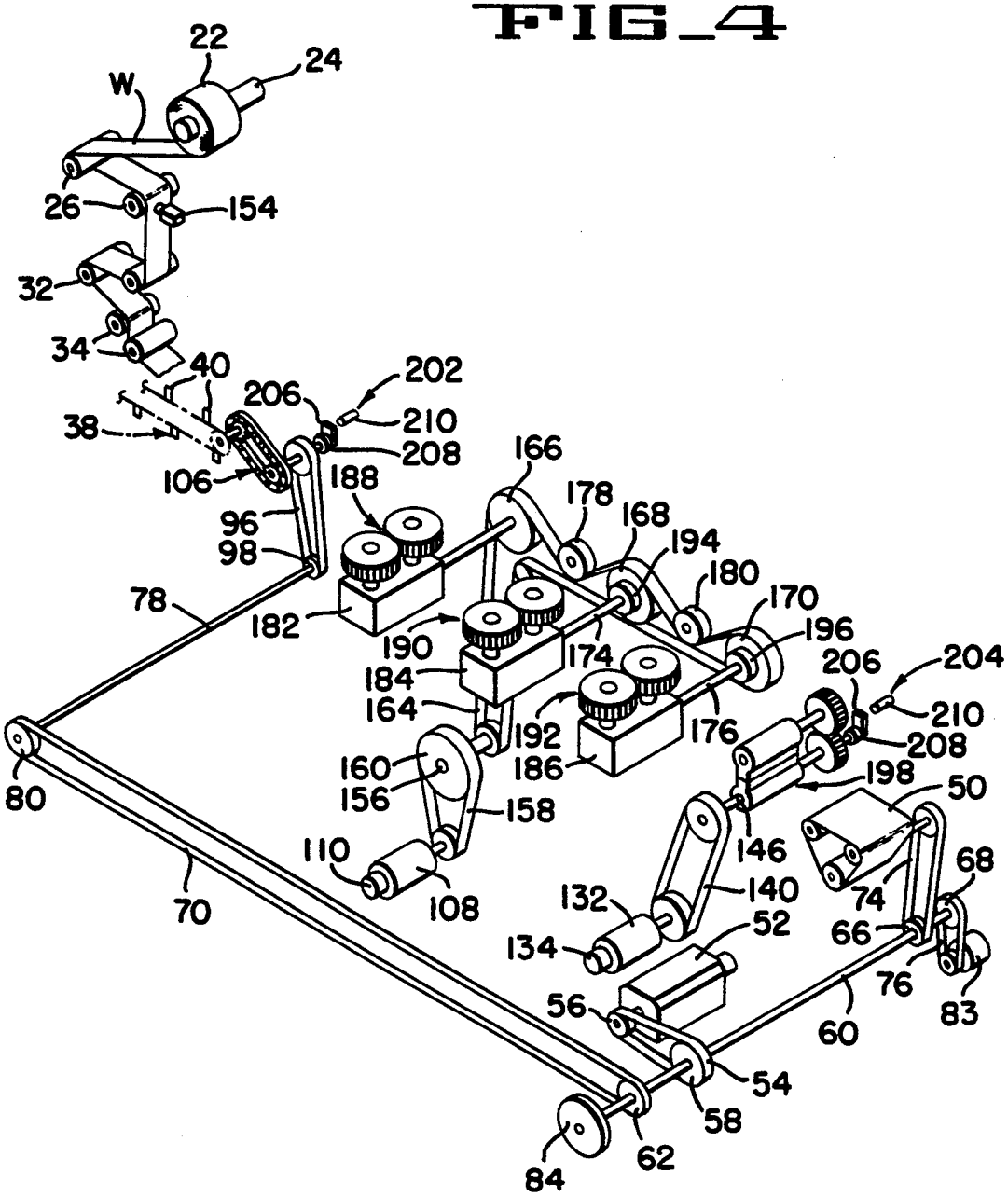
FIG. 4 is substantially similar to FIG. 3 but the drive to sealing/crimper and cutoff jaws is by means of a variable velocity servo motor, FIG. 5 discloses a wrapper driver arrangement similar to FIG. 2 with the exception that a single 2-up crimping head is driven by a servo motor.

The wrapping machine drive arrangement shown in FIG. 4 is similar to the arrangement shown in FIG. 3 and accordingly the corresponding structures will be identified by the same numerals. As in the prior arrangements input power to the crimping head 198 is supplied to servo motor 132 being directly connected to drive the shaft 146 by the belt and pulley transmission 140. To achieve cyclic variable velocity of the crimping head 198 the servo motor 132 accesses a program in the industrial computer to provide the appropriate cyclical speed variation for a specified wrapping application, as will hereafter be described. The arrangement shown in FIG. 4 renders unnecessary the slot drive unit 136 which, as mentioned above, transforms a constant input rpm to a cyclically variable velocity. By achieving variable cyclic velocity of the crimping heads 198 by constantly varying the velocity of the servo motor 132 may require, since electrical current peaks are high, forced air cooling to the servo motor. Direct servo drive to the crimping head 198 may be best suited for single head wrapping applications where there are many different article sizes to be wrapped and where size changeover is to be quickly performed and at the same time allowing use of a less skilled operator.

Figure 5:
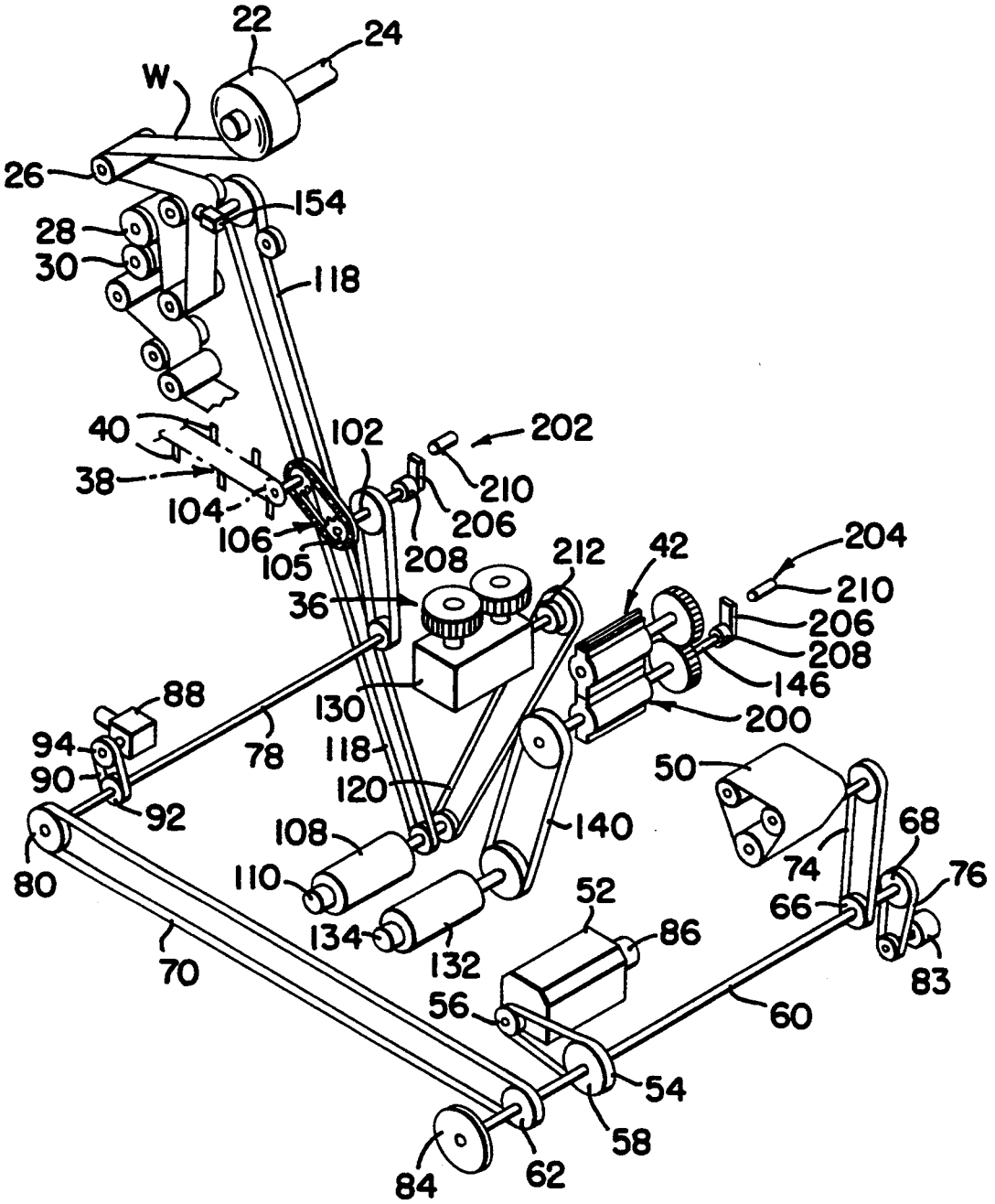

The arrangement of the wrapper components shown in FIG. 5 in large part includes a major portion of the components shown in FIG. 2 but deviates therefrom by eliminating PTO 82 and providing for the direct drive, by servo motor 132, of a 2-up crimping head 200 whose velocity is cyclically varied during each 180° of revolution by computer control.

The wrapper configurations shown in FIGS. 2 to 5 all include a detector 202 including a radially projecting flag 206 mounted on a shaft 102 driving the infeed conveyor 38 and a detector 204, of similar construction, including a radially projecting flat 206 which is mounted on shaft 146 of the crimper head 42. The radially projecting flag 206 carried by collar 208 adjustably mounted to the shaft 102 and a light source 210 being operative to generate a pulse when the flat 206 crosses its light path during each revolution of the shaft 102. In setting up the machine the photo detector 202 is correlated with the position of the lugs or flight 40 of the infeed conveyor 38. Preferably, a pulse is generated by the detector 202 as each flight 40 loses contact with an article which is inserted into the web tube. That condition can always be established for a particular product length since the collar 208 can be adjusted so that the pulse created always occurs when the flight 40 comes out of contact with the article being inserted into the web tube. The pulse generated by the detector 202 is sensed by the computer and provides a reference signal for controlling relative velocity of the entire drive train. The encoder 83 being driven, through belt 76, by the shaft 60 provides digital velocity and position signal corresponding to the velocity and position of the main drive motor 52 which is used by the computer to generate control signals for servo motors 108 and 132. The flat 206 associated with detector 204 is adjusted on shaft 146 so that a pulse is generated when the sealing and crimping faces of the crimper head carried by shaft 146 are completely closed.

Servo motor 108 drives all web feeding and tensioning elements in the system by means of belts 118 and 120 driving, respectively, the feed rolls 28 and 30, and fin wheel 36. The feed rolls have primary control over web velocity and print registration through the agency of encoder 110 providing a digital feedback signal for velocity and position of the web. The computer (hereinafter identified) is programmed so that servo motor 108 follows the master encoder 83 at a preset ratio to thereby feed a selected amount of web material for each flight 40 advanced by the main drive motor 52. Accurate control of web velocity is provided by the print registration scanner 154 inputting a pulse to the computer on the detection of a registration mark and in turn, through the computer, servo motor 108 maintains a position relationship between the web registration mark and the flight 40 of the infeed conveyor 38. By these measures very accurate control of the web cutoff and print registration is achieved through control of the web feed rolls 28 and 30.

To achieve and maintain a desired web tension as the web leaves the web feed roll 28 and 30 the drive to the fin wheels 36 (FIG. 2) includes a commercially available adjustable torque device 212 which is set or adjusted so that the surface velocity of the fin wheels 36 is approximately five percent over speed relative to the speed or surface velocity of the fin wheels 26 and 28 when running without web between the wheels 36. The adjustable torque device serves to tension the web by slipping at a preset torque level and thereby produces a desired web tension between the feed rolls 28 and 30 and the set of fin wheels 36.

Servo motor 132 serving to drive the crimping and sealing heads of 42 and 44 provides, by means of the encoder 134, a feedback digital velocity signal corresponding to the velocity of one of the input shafts 142 or 144 of the slot drive units 136 and 138. The computer is programmed to compare the velocity feedback signal from encoder 134 with the velocity of the reference signal of encoder 83 to effect control of servo motor 132 such that a 1:1 ration between the input shafts 142 and 144 of the slot drives 136 and 138 will make one revolution for each advance of a light 40 of the infeed conveyor 38. Detector 204 monitors motion of the lower cutting head shaft and produces an output pulse for each crimping, sealing and cutting cycle. The computer is programmed to compare pulses it receives from detectors 202 and 204 relative to the infeed conveyor 38 and to control servo motor 132 in such a way as to maintain a preset desired phase relationship between the pulses generated by detectors 202 and 204. In this way the computer and servo motor 132 control the phasing of the cutting head to the article within the tube of packaging material.

Directly driving a crimping head, shown in the machine configurations of FIGS. 4 and 5, eliminates the need of a slot drive unit such as unit 136, and the requirement of cyclic variable velocity is fulfilled by the computer. While the mechanical drive arrangement is simple, electronically it is more complex because the servo drive arrangement for the servo motor 132 must, during every revolution vary the velocity. More particularly, the computer is provided with a program accessed by the encoder 134 to effect the cyclical varying velocity.

Figure 7A:
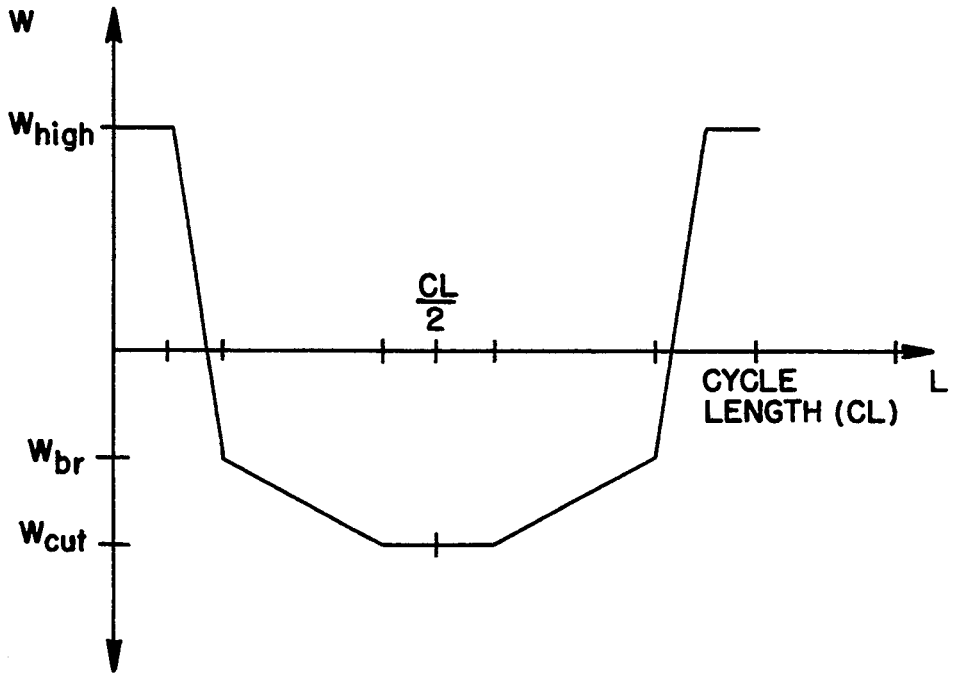
FIGS. 7A and 7B are graphs of computer generated velocity profiles for driving the variable velocity servo motors of FIGS. 4 and 5, and FIGS. 8A, 8B and 8C are schematic representations of a wrapped product and the crimping heads showing the respective variables associated with each.
Figure 7B:
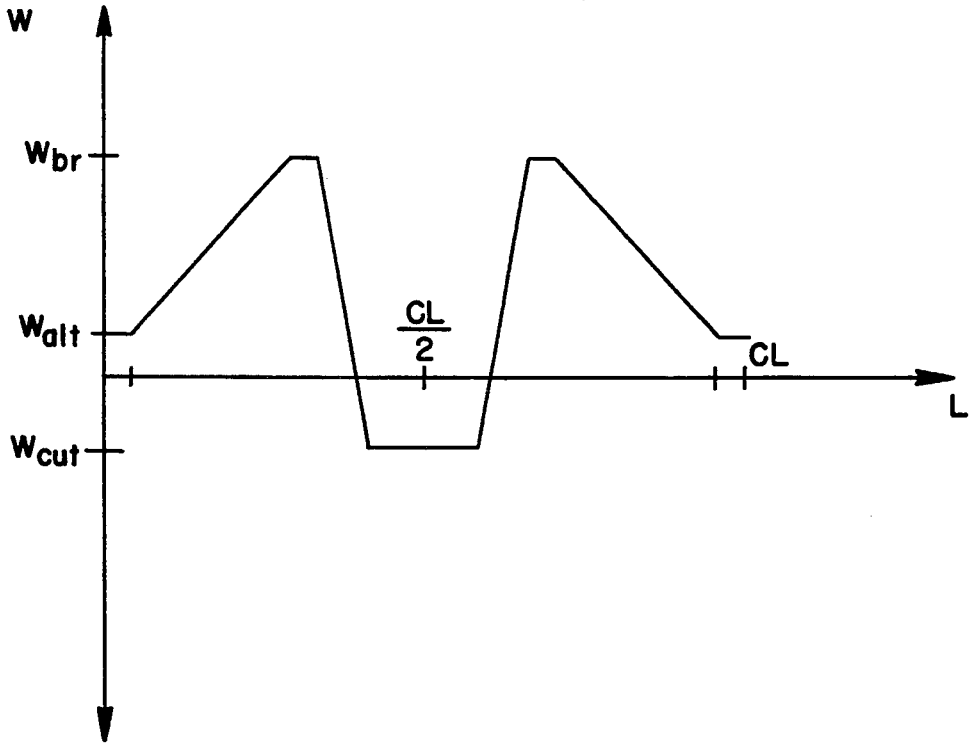
Figure 8A:
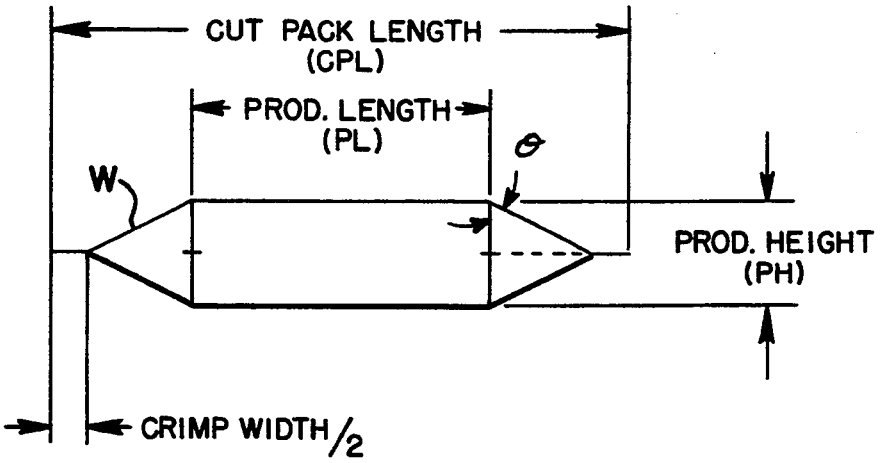
Figure 8B:
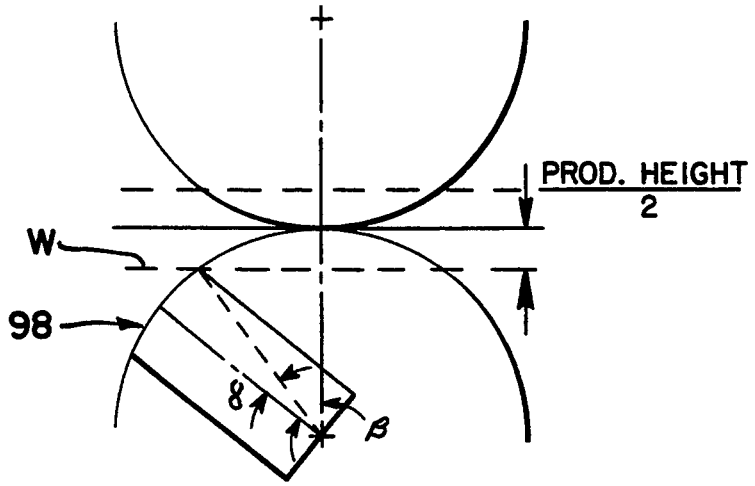

The output signal from the computer to servo motor 132 is a direct ratio to the input signal from encoder 83 to the computer. The computer is programmed to drive servo motor 132 at one of two or more cyclical velocity profiles. Two of these velocity profiles are depicted in FIGS. 7A and 7B, where $\omega$ is the angular velocity of shaft 146 and L is the angular position of shaft 146. The velocity profiles depict the varying angular velocities of shaft 146 between engagements of crimping heads 198 as shaft 146 revolves. The computer selects the appropriate profile depending on the length and height of the product being wrapped and the number of crimping heads 198 being employed. During the start-up of the job run, the computer initially computes the velocity profile depicted in FIG. 7A. The computer computes velocity profile 7A by first calculating the value for $\omega_{cut}$, the angular velocity of shaft 146 when crimping heads 198 are aligned in a position to crimp and cut the web W, as depicted in FIG. 4. The value of $\omega_{cut}$ is determined so that the linear velocity at the ends of crimping heads 198 is equal to the feed speed of web W to ensure that crimping heads 198 do not tear web W or cause it to bind upstream of crimping heads 198. The value of $\omega_{cut}$ is thus determined by the following formula:

$$\omega_{cut}=(CPL)(PPM)/R_h, \quad [1]$$

where CPL is the cut pack length, PPM is the product feed rate or number of products to be packaged per minute and $R_h$ is the radius of crimping head 198, which is the distance from the centerline of shaft 146 to the cutting end of crimping head 198. PPM is a value either input by the operator during the job setup or determined by means such as encoder 83 and supplied to the computer during operation of the wrapping machine. CPL depends upon other factors input into the computer during the job setup and is determined from the following formula:

$$CPL=PL+CW+(PH)(\tan\theta), \quad [2]$$

where PL is the product length, CW is the crimp width, which is half the width of crimping head 198, PH is the product height and $\theta$ is the crimp angle, which is determined from the following formula:

$$\theta=\cos^{-1}[PH/(Repeat-PL-CW)], \quad [3]$$

where Repeat is the length of web W between successive cuts. The values for $R_h$, PL, CW, PH and Repeat are typically entered into the computer by the operator. These variables are illustrated in FIG. 8A, which depicts a representative product sealed within web W. After $\omega_{cut}$ is determined, the value for $\omega_{br}$ is calculated. This situation is schematically represented in FIG. 8B. The value $\omega_{br}$ corresponds to the angular velocity of shaft 146 when crimping heads 198 first engage web W. The value for $\omega_{br}$ is always greater than the value for $\omega_{cut}$ because shaft 146 is required to sow down while crimping heads 198 are collapsing web W so as not to interrupt the feed speed of web W. The value $\omega_{br}$ is determined by the following formula:

$$\omega_{br}=[(Repeat)(PPM)]/[R_h-(PH/2)]. \quad [4]$$

Figure 8C:
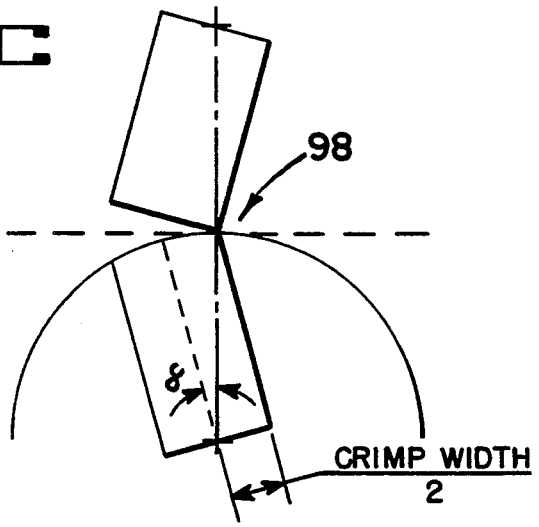

The value for $\omega_{high}$ is dependent upon the time required to crimp and cut web W and must be great enough to ensure that crimping heads 198 complete their revolution and are in the proper position to crimp and cut again. The value $\omega_{high}$ is therefore determined from the following formula:

$$\omega_{high}=[-C_2+sqrt\{C_2^2-4C_1C_3\}]/2C_1 \quad [5]$$

where C1, C2, C3 are determined from the following formulas:

$$C_1=T-2\gamma/\omega_{cut}-[4(Ang-\gamma)/(\omega_{br}+\omega_{cut})]; \quad [6]$$

$$C_2=C_1\omega_{br}-2CL+2\gamma+4Ang;\ and \quad [7]$$

$$C_3=-2\gamma\omega_{br}, \quad [8]$$

where T is the time required to rotate shaft 146 between crimping heads 198 or, expressed another way, 1/PPM, CL is the length of a cycle between crimping heads 198, which depends on the number of crimping heads being used and can be expressed simply as 360/number of crimping heads, $\gamma$ is the angle from vertical of crimping heads 198 when the leading edges of crimping heads 198 first engage each other (FIG. 8C), and Ang is an angle which is initially assigned a value p. The angle p is the angle from vertical of crimping heads 198 when they first engage web W (FIG. 8B) and is determined by the following formula:

$$\beta=\gamma+\cos^{-1}[(2R_h-PH)/2R_h]. \quad [9]$$

If the height of the product being wrapped is great, the velocity profile utilized may not provide for sufficient time to accelerate crimping heads 198 between engagements or crimps. Consequently, before $\omega_{high}$ is calculated, Ang is adjusted downwards in increments of $(0.1)\gamma$ until $2\gamma+2Ang$ is less than or equal to CL.

If $\omega_{br}$ is determined to be greater than $\omega_{high}$, as is often the case when the height of the product to be wrapped is great, then the computer will select the profile depicted in FIG. 7B, where $\omega_{alt}$ is determined from the following formula:

$$\omega_{alt}=[-C_5+sqrt\{C_5^2-4C_4C_6\}]/2C_4, \quad [10]$$

where $C_4$, $C_5$ and $C_6$ are determined from the following formulas:

$$C_4=T-2\gamma/\omega_{cut}-\gamma/\omega_{br}-4(Ang-\gamma)/(\omega_{br}+\omega_{cut}); \quad [11]$$

$$C_5=C_4\omega_{br}-2CL+4Ang+3\gamma;\ and \quad [12]$$

$$C_6=-\gamma\omega_{br}. \quad [13]$$

Once the computer determines which velocity profile best suits the particular job application to be run, the computer will then optimize the velocity profile based on the parameters entered into the computer by the operator or via apparatus incorporated into the wrapping machine, such as encoder 83. A main factor which affects the optimization of the velocity profile is the torque required to accelerate crimping heads 198 between the crimping cycles. This acceleration is represented by the portion of the curve in FIG. 7A between $\omega_{br}$ and $\omega_{high}$. If, in the velocity profile depicted in FIG. 7A, the torque required to achieve the acceleration is greater than the torque that can be generated given the torque limitations of servo motor 132, then the computer will increase $\omega_{br}$ by increments of $(0.01)\omega_{br}$ until either servo motor 132 is capable of supplying the required torque or $\omega_{br}=\omega_{high}$, whichever occurs first. As is understood by those of skill in the art, the torque that can be generated on shaft 146 by motor 132 is dependent upon the actual torque rating of motor 132, the structure of the drive train between the motor and the crimping heads and the crimping heads themselves. If, in the velocity profile depicted in FIG. 7B, the torque required to accelerate the crimping heads between $\omega_{cut}$ and $\omega_{br}$ is greater than the torque that can be generated on shaft 146 by motor 132, then the computer will increase Ang by increments of $(0.01)\gamma$ until motor 132 is capable of providing the required torque or $2Ang+2\gamma$ is greater than CL. The computer will then calculate a new $\omega_{alt}$ from this value of Ang. In this manner, the velocity profiles are adjusted so that motor 132 will drive shaft 146 at the optimum cyclical velocity for a given product run. The velocity profile optimization thus achieved results in a better crimp or seal since crimping heads 198 travel at the velocity of web W during the actual crimp and cut operation no matter what the product dimensions or product feed rate (PPM), a greater product feed rate capacity, greater crimping cycle speeds, and, consequently, the ability to select a smaller, less expensive servo motor 132.

The design of the servo motor 132 and its controller in this arrangement is much more critical because of load accelerations and decelerations that are not smoothed out by the flywheel effect of a slot drive and accordingly current peaks are high, requiring proper sizing of servo motor 132 and its electrical conductors. Moreover, the duty imposed on servo motor 132 may require forced air cooling. While the direct drive arrangement can be used in multiple crimping head applications, it is particularly suited for single head wrapping applications where there are many different article sizes to be wrapped, where size changeover is to be quickly performed and where operator skill requirements are minimized. For example, to effect cyclical speed variations for the crimping head, the operator merely has to input information into the computer concerning the article to be wrapped, or in the event the computer contains the job code in memory, that information is brought up to the active record, meaning the job being run.

Figure 6:
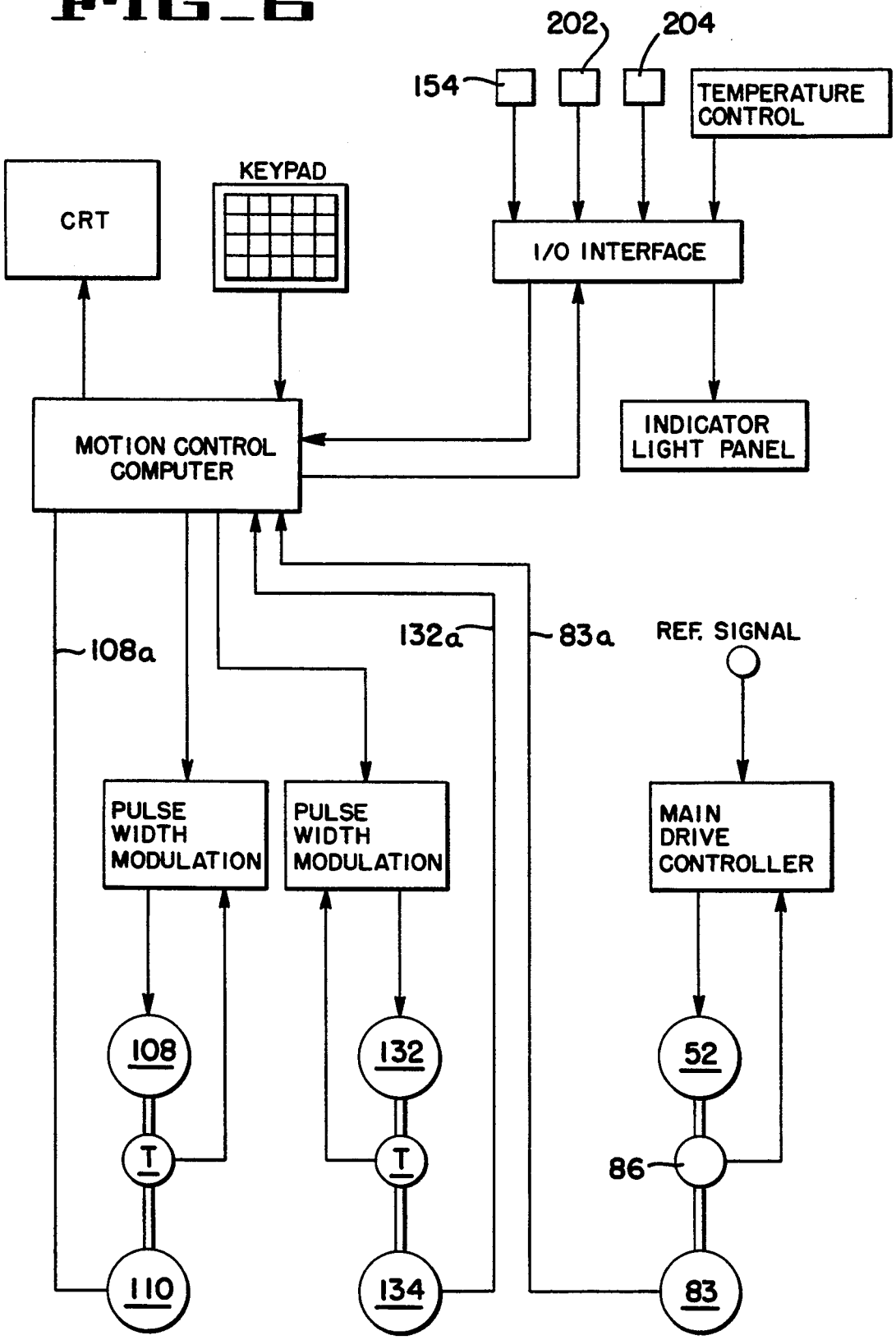
FIG. 6 is an electrical schematic illustrating the major electrical and electronic components and their interconnections.

FIG. 6 is a schematic of the major drive and control elements of the system showing their integration with the motion controlled computer. The master or main drive motor 52 is electrically connected to a controller which receives a reference signal which may be a set voltage such as one established by a potentiometer or a varying voltage which may be automatically varied according to transitory or transitional conditions or the voltage may be input in accordance with the rate at which a process is operating. This signal is input to the controller and the speed of the main motor 52 is proportional to the input reference signal. Tachometer 86 connected to the controller provides an indication of motor speed to the controller and thus constitutes a closed loop speed control of the motor 52. The encoder 83, driven by the motor 52, inputs a velocity signal through line 83*a* to the motion control computer and, as mentioned above, this velocity signal establishes a reference velocity for the servo motors 108 and 132. Servo motors 108 and 132 are associated with pulse width modulated drive controllers (PWM) regulating power to servo motors 108 and 132. Tach T provide a velocity signal to the pulse width modulators, thereby establishing closed loop control. Velocity signals of the servo motors 108 and 132 are supplied to the computer by lines 108*a* and 132*a*. A CRT or other display means displays a variety of information which may include conditions of machine operation and information prompted by the operator's use of the keypad to call up or establish a record. Also connected to the motion control computer by an I/O interface are the registration mark detector 154, the dog drop off detector 202, the crimper position detector 204, and a temperature control and light indicator panel. A keypad or similar input device is connected to the computer to input parameters necessary to run a particular wrapping job.

With respect to computer controlled wrapping machines of the prior art it is very significant that the disclosed computer controller wrapping machine can automatically respond to changes in supply rate of the process because the wrapping rate can be controlled by an analog signal to the DC drive control of the wrapper main drive motor 52. Further, as compared to prior art computer controller wrapping machines, the disclosed wrapping machine of the present invention is well suited for tie-in with accessory equipment on a 1:1 relationship and is well-suited to be subservient to a process for purposes of controlling article backlog in response to supply rate changes. Moreover, the computer control drive arrangements of the disclosed wrapper are digitally controlled on a machine-timed basis enabling error sensing and proportional corrections in machine-timing so that corrections may occur during acceleration and deceleration as well as during constant velocity operations of the machine. Further, with regard to the control system in the present invention, the disclosed system distinguishes from current commercially available systems because the main drive pulse generator is a 1:1 shaft. This produces perfectly spaced machine-time reference pulses and is preferable to obtaining timing reference pulses by the sensing of flights, dogs or articles which are not perfectly spaced or oriented. The hand wheel 84 secured to the shaft 60 allows the wrapper to function in the event the operator wishes to make sole packages while the main motor 52 is deenergized. This is possible since the disclosed computer controlled servo drive mechanism enables the servo slave motors to follow the deenergized main drive motor 52 when the motor is hand wheel operated in either direction.

Although the best mode contemplated for carrying out the present invention has been herein shown and described, it will be apparent that modifications and variations may be made without departing from what is regarded to be the subject matter of the present invention.

What is claimed is:

1. A method of operating a horizontal wrapping machine comprising a supply drive motor for supplying a succession of regularly spaced articles from an article supply into a tubular web, means for feeding and sealing the margins of the formed web, and means for transversely sealing and cutting the web tube to produce packages having at least one article contained therein, the method comprising the steps of:

generating a signal representative of the velocity and position of the article supply drive motor;

digitizing the velocity and position signal;

generating a first cyclical velocity profile proportional to the velocity and position signal;

using the first velocity profile to control the velocity and position of the sealing and cutting means; and adjusting the first velocity profile in order to minimize the time required for the sealing and cutting means to complete a cycle when the height of the articles exceeds a value which is dependent upon the height and length of the articles and the dimensions of the sealing and cutting means.

2. The method of claim 1, further comprising the steps of:

generating a second velocity profile proportional to the velocity and position signal when the height of the articles exceeds a value which is dependent upon the height and length of the articles and the dimensions of the sealing and cutting means; and using the first velocity profile to control the velocity and position of the sealing and cutting means.

3. A horizontal wrapping machine comprising:

a wrapper;

a crimper;

a master motor having a master encoder coupled thereto;

a web feed and fin seal motor having a slave encoder coupled thereto;

a sealing head motor having a slave encoder coupled thereto;

an industrial computer receiving input signals from said master encoder and sending output signals to said web feed and fin seal motor and to said sealing head motor; said output signal to said web feed and fin seal motor being proportional to the input of the master encoder at a preset ratio to thereby feed a selected amount of web to said wrapper; and said output signal from said computer to said crimper and sealing head motor being a direct ratio to said master encoder input to said computer;

said output signal from said computer to said crimper and sealing head motor comprising a velocity profile; and wherein said industrial computer functions to automatically adjust said velocity profile in order to minimize the time required for the sealing and cutting means to complete a cycle when the height of the articles exceeds a value which is dependent upon the height and length of the articles and the dimensions of the sealing and cutting means.

* * * * *